United States Patent [19]

Duve

[11] Patent Number: 4,672,348

[45] Date of Patent: Jun. 9, 1987

[54] ELECTRICAL COIL ASSEMBLY AND TERMINAL THEREFOR

[75] Inventor: John P. Duve, Brookfield, Ill.

[73] Assignee: Eaton Corporation, Cleveland, Ohio

[21] Appl. No.: 702,776

[22] Filed: Feb. 19, 1985

[51] Int. Cl.[4] ..... H01F 15/10

[52] U.S. Cl. ..... 336/192; 439/396; 439/751; 439/883; 439/873

[58] Field of Search ..... 336/192; 339/95 R, 97 R, 339/97 P, 98, 99 R, 220 R, 221 R, 277 R, 277 C; 310/71; 174/159

[56] References Cited

U.S. PATENT DOCUMENTS

| | | | |
|---|---|---|---|
| 1,921,823 | 8/1933 | Hosking | 339/277 R |
| 2,811,705 | 10/1957 | Schumacher | 339/277 R X |
| 3,117,294 | 1/1964 | Muszynski et al. | 336/192 |
| 3,189,772 | 6/1965 | Wingler et al. | 336/192 X |
| 3,359,520 | 12/1967 | Foerster | 336/192 |
| 3,496,504 | 2/1970 | Daley | 336/192 X |
| 3,663,914 | 5/1972 | Lane | 336/192 |
| 3,974,407 | 8/1976 | Dochterman | 339/97 P X |
| 3,979,615 | 9/1976 | Neff | 336/192 |
| 3,984,908 | 10/1976 | Ackley | 29/205 D |
| 4,038,573 | 7/1977 | Hillyer et al. | 336/192 |
| 4,041,604 | 8/1977 | Ackley | 29/628 |
| 4,287,446 | 9/1981 | Lill et al. | 310/71 |
| 4,322,647 | 3/1982 | Neroda et al. | 310/71 |
| 4,546,340 | 10/1985 | Kuchuris | 336/192 |

FOREIGN PATENT DOCUMENTS

| | | | |
|---|---|---|---|
| 277804 | 5/1952 | Switzerland | 174/159 |

*Primary Examiner*—Thomas J. Kozma

*Attorney, Agent, or Firm*—D. A. Rowe; R. A. Johnston

[57] ABSTRACT

An electrical coil assembly includes a bobbin having a pair of generally parallel end plates with a pair of terminals inserted into holes in an edge in one of the end plates. A wall is attached to that one of the end plates and extends radially outward therefrom, being formed with a pair of crossholes each aligned with one of the blind holes. A pair of terminals are partially inserted into the blind holes. Each of the terminals includes an elongated slot of reduced width at the end remote from the end plate. A portion of the terminal slot material is lanced out to form a tab at that remote end of the terminal. The close in ends of the terminal slots are lined up with the crossholes. Magnet wire is then wound on the bobbin hub and the two ends of the magnet wire are dressed through respective terminal tabs and then resistance welded thereto. A layer of protective tape is then applied over the surface of the wound coil. Prestripped lead wires are inserted through the crossholes of the wall and through the lower end of the terminal slots. Finally, the terminals are driven in the remainder of the blind hole depth. As a result, the reduced terminal slot widths cut into the lead wires, creating both electrical and mechanical connections.

6 Claims, 9 Drawing Figures

ELECTRICAL COIL ASSEMBLY AND TERMINAL THEREFOR

BACKGROUND OF THE INVENTION

This invention relates to electrical coil assemblies.

It is an object of the present invention to provide an electrical coil assembly which may be manufactured either manually or completely automatically.

It is another object of this invention to provide such an assembly with a minimum number of parts.

It is a further object of this invention to provide an extremely reliable electrical coil assembly.

It is yet another object of the present invention to provide such an assembly having a very low cost.

It is still a further object of this invention to provide an improved terminal for connecting a lead wire to the magnet wire forming the coil.

SUMMARY OF THE INVENTION

The foregoing and additional objects are attained in accordance with the principles of this invention by providing an electrical coil assembly adapted for connection to at least one lead wire comprising a bobbin having a coil receiving central portion and a pair of generally parallel end plates at either end of the central portion defining a coil receiving channel, a coil wound on the central portion of the bobbin within the channel, and at least one terminal fixed on one of the end plates, each of the terminals comprising a unitary member having a coil wire receiving tab and a lead wire receiving slot, the slot being elongated in a radial direction with respect to the bobbin, the radially inward end of the slot being dimensioned sufficiently to receive a lead wire therethrough, and the lateral dimension of the slot decreasing therefrom to a region of lateral dimension smaller than the diameter of the lead wire.

BRIEF DESCRIPTION OF THE DRAWINGS

The foregoing will be more readily apparent upon reading the following description in conjunction with the drawings in which like elements in different figures thereof have the same reference character applied thereto and wherein.

DETAILED DESCRIPTION

Figure 1:
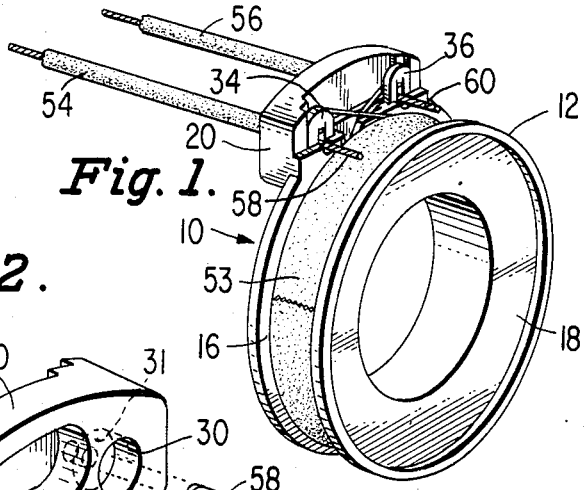
FIG. 1 is a perspective view showing a complete electrical coil assembly according to this invention.
Figure 2:
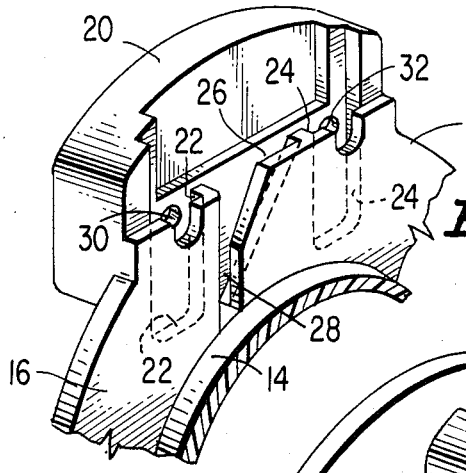
FIG. 2 is an enlarged perspective detail of the bobbin in the vicinity of the terminals.
Figure 3:
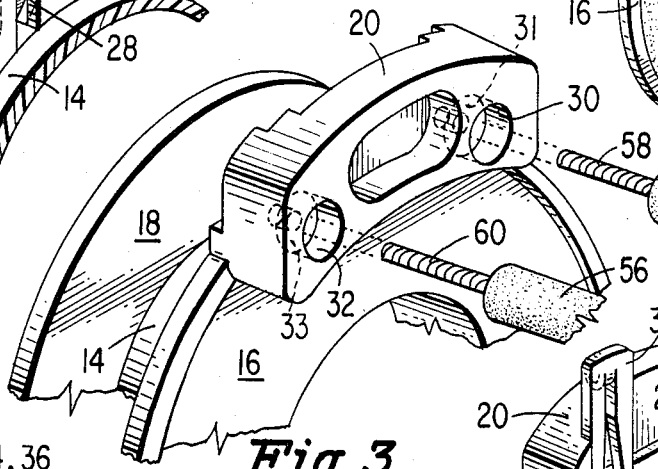
FIG. 3 is an enlarged perspective detail of the bobbin in the vicinity of the terminals taken in a direction opposite to that shown in FIG. 2.

A major component of the electrical coil assembly according to this invention, which assembly is generally designated by the reference numberal 10, is the bobbin 12. The bobbin 12 has a coil receiving central portion 14 and a pair of generally parallel end plates 16 and 18 at either end of the central portion, or hub, 14 which together define a coil receiving channel. Preferably, the bobbin 12 is formed as a unitary molded plastic piece, illustratively of nylon material. The bobbin 12 further includes a wall 20 attached to the end plate 16 and extending radially outward from the end plate 16.

Within the angular extent of the wall 20, the end plate 16 is formed with a pair of blind holes 22 and 24 which extend into the end plate 16 generally parallel thereto. In addition, the end plate 16 is formed with a generally triangular shaped slot 26 which extends down to the level of the coil receiving central portion 14 and is open at 28 to the coil receiving channel. The slot 26 is a coil starting slot.

The wall 20 is formed with a pair of openings 30 and 32 therethrough. Each of the openings 30,32 is aligned with one of the blind holes 22,24 substantially at the top thereof. Each of the openings 30,32 is formed as a stepped bore having an internal shoulder 31,33 so that when the end of a lead wire is stripped of its insulating sleeve, the lead wire can extend all the way through the wall 20, within an opening 30,32 but the insulating sleeve surrounding the remainder of the lead wire is prevented by the internal shoulder 31,33 from passing completely through the wall 20.

Figure 4:
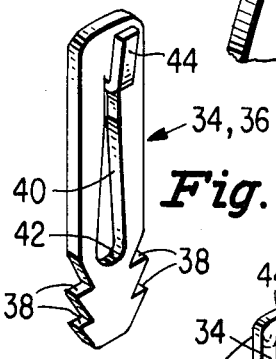
FIG. 4 is an enlarged perspective view of a terminal constructed in accordance with the principles of this invention.

The coil assembly 10 also includes a pair of terminals 34 and 36 which are adapted for insertion into the blind holes 22 and 24, respectively. For the sake of uniformity and cost efficiency, the terminals 34 and 36 are preferably identical and are constructed as shown in FIG. 4. Preferably, each of the terminals 34,36 is stamped from brass stock to have a plurality of barbs 38 at one end thereof. The purpose of the barbs 38 is to engage the sides of the respective blind holes 22,24 to prevent removal of the terminals 34,36 therefrom. Each of the terminals 34,36 has a slot 40 formed therein. This slot is for the purpose of receiving a lead wire therein and is of varying lateral dimension. Thus, the end 42 of the slot 40 which is radially inward when the terminal 34,36 is inserted in its blind hole is dimensioned sufficiently to receive a lead wire therethrough. The lateral dimension of the slot 40 at increasing distances from the end 42 is decreased to a region of lateral dimension smaller than the diameter of the lead wire. At the distal end of the slot 40, some of the material removed during formation of the slot 40 is folded over to form a tab 44. The tab 44 is for the purpose of receiving coil wire.

Figure 5:
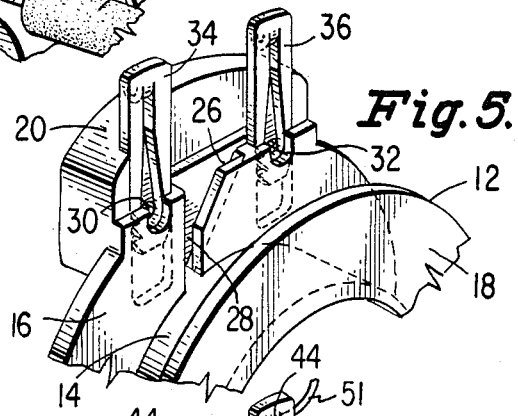
FIGS. 5–9 illustrate the assembly sequence according to this invention.
Figure 6:
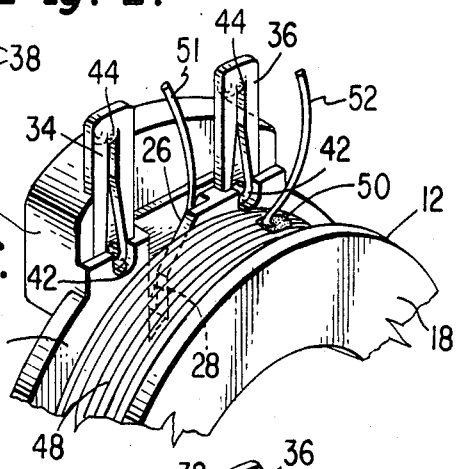
Figure 7:
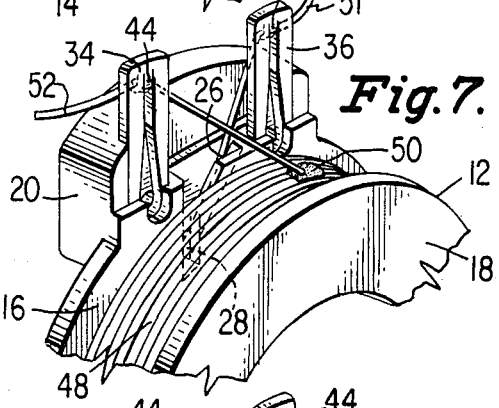
Figure 8:
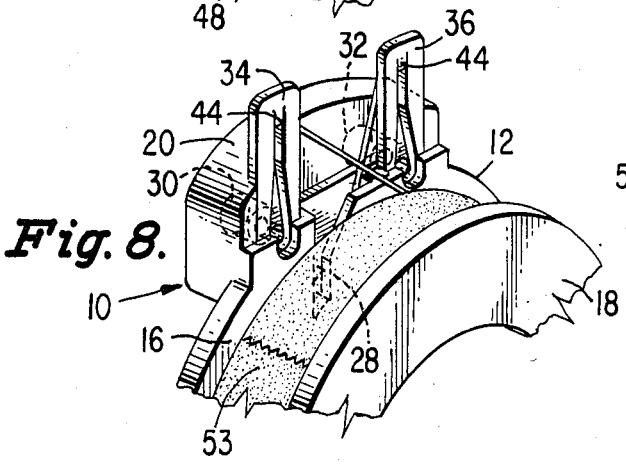
Figure 9:
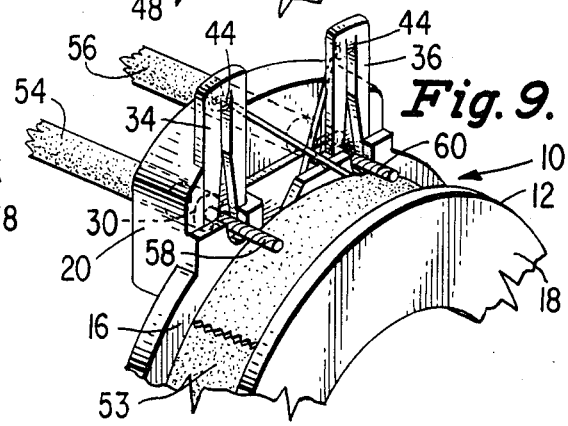

The assembly and construction of the electrical coil assembly 10 will now be described. The bobbin 12 is fed to an assembly machine, where the terminals 34 and 36 are inserted partially into the blind holes 22 and 24, respectively, so that the ends 42 of the slots 40 are aligned with the openings 30 and 32 in the wall 20, resulting in the construction shown in FIG. 5. Magnet wire is then wound on the central portion 14 of the bobbin 12, to form a coil 48, as shown in FIG. 6. The starting end 51 of the coil 48 emerges from the slot 26 and the finish end 52 is held on the surface of the coil 48 by a wax dot 50. The operator then dresses the loose ends 51,52 of the coil 48 through the tabs 44 of the terminals 34 and 36, as shown in FIG. 7, and then this assembly is inserted into a welding machine which resistance welds the ends 51,52 of the coil 48 to the terminals 34 and 36. The excess ends of the coil 48 are then cut. A layer of protective insulated tape 53 is then applied to the surface of the coil 48, as shown in FIG. 8. Next, pre-stripped lead wires 54 and 56 are inserted into the openings 30 and 32, respectively, of the wall 20 bottoming out in the shouldered openings 30 and 32, with the uninsulated wire portions 58 and 60 continuing through the openings 30 and 32 and through ends 42 of the slots 40 of the terminals 34 and 36, as shown in FIG. 9. Finally, the terminals 34 and 36 are driven in the remainder of the depth of the blind holes 22 and 24, resulting in the construction shown in FIG. 1. During this operation, the reduced width of the slots 40 of the terminals 34 and 36 cut into the uninsulated wire portions 58 and 60, creating both an electrical and mechanically connection. Preferably the terminals 34,36 are oriented in the blind holes 22,24 so that the tabs 44 are facing the wall 20 This provides an extra measure of protection to the connections to the coil 48. Thus, there has been constructed an advantageous electrical coil assembly without soldering operations that provides a reliable, firm connection between the coil winding and the external leads and can be automated in manufacturing.

Although this invention has been illustrated with two lead wires, there are applications envisioned where only a single lead wire would be connected to the coil. Thus, certain low voltage grounded automotive coils have one end of the coil connected to a lead wire and the other end of the coil welded to the coil bobbin core which is then fastened directly to the automotive frame. Additionally, while this invention has been illustrated with pre-stripped lead wires, it is contemplated that the wall openings and terminal slots could be dimensioned so that an insulated wire could pass therethrough and when the terminals are driven into their blind holes, the reduced width slots would cut through the insulation and into the wire.

Accordingly, there has been disclosed an improved electrical coil assembly. It is understood that the above-described embodiment is merely illustrative of the application of the principles of this invention. Numerous other embodiments may be devised by those skilled in the art without departing from the spirit and scope of this invention, as defined by the appended claims.

I claim:

1. An electrical coil assembly adapted for connection to at least one electrical lead wire comprising:

a bobbin having a coil receiving central portion and a pair of generally radially outwardly extending end flanges disposed on opposite ends of said coil receiving portion, said flanges and said central portion thereby defining a coil receiving channel;

a coil of electrically conductive material wound on the central portion of said bobbin within said channel; and, one of said end flanges having at least one terminal-receiving recess formed therein;

at least one electrically conductive terminal having one end thereof provided with push-in engagement surfaces with other portions thereof defining wire retaining surfaces, said retaining surfaces converging in a direction away from said one end, said terminal having a lug extending therefrom and disposed generally distal said one end;

said at least one terminal having the one end thereof received in said bobbin flange recess in engagement therewith in a first position, said wire retaining surface being operative in said terminal first position to permit an electrically conductive lead to be inserted into said terminal therebetween, said terminal operative, upon movement of said one end to a second position further engaging said recess, to cause an electrical lead inserted through said terminal in said first position to be forced against adjacent portions of said flange and wedged between said retaining surfaces for retention therein; and said coiled having an end thereof secured to said terminal lug in electrically conductive engagement.

2. The coil assembly defined in claim 1 wherein said one bobbin flange has an opening in an axial face thereof communicating with said recess, said opening permitting an electrical lead to be inserted therethrough when said terminal is in said first position.

3. The coil assembly defined in claim 1 wherein said wire retaining surfaces comprise opposite sides of a tapered slot formed in said terminal.

4. The coil assembly defined in claim 1 wherein said push-in engagement surfaces comprise a plurality of barbs.

5. The coil assembly defined in claim 1 wherein said wire retaining surfaces comprise opposite sides of a tapered slot formed in said terminal; and, said lug comprises a tab formed by at least portions of material displaced to form said slot.

6. The coil assembly defined in claim 1, further comprising a terminal block portion formed integrally with said one flange, said block having a spaced pair of said recesses formed therein, with one of said terminals received in each of said recesses, said terminal block having a pair of cut-outs formed therein each cut-out adjacent to and communicating with one of said terminal-receiving recesses, with each said cut-out having a shouldered surface therein and operative, upon insertion of the stripped end of an insulated wire lead therein, to limit the depth of insertion and register against the end of the stripped insulation.

* * * * *